US006318769B1

(12) United States Patent
Kang

(10) Patent No.: US 6,318,769 B1
(45) Date of Patent: Nov. 20, 2001

(54) BACKSET ADJUSTMENT STRUCTURE OF DEAD BOLT ASSEMBLY FOR DOOR LOCK

(75) Inventor: Eui Shik Kang, Daegu-si (KR)

(73) Assignee: Hyundae Metal Co., Ltd., Daegu-si (KR)

( * ) Notice: Subject to any disclaimer, the term of this patent is extended or adjusted under 35 U.S.C. 154(b) by 0 days.

(21) Appl. No.: 09/443,143

(22) Filed: Nov. 19, 1999

(30) Foreign Application Priority Data

Mar. 11, 1999 (KR) ..... 99-3869

(51) Int. Cl.[7] ..... E05C 1/00
(52) U.S. Cl. ..... 292/1.5; 292/337
(58) Field of Search ..... 292/1.5, 337, DIG. 60, 292/DIG. 37

(56) References Cited

U.S. PATENT DOCUMENTS 4,593,542 * 6/1986 Rotondi ..... 70/134
4,602,490 * 7/1986 Glass ..... 70/134
4,772,055 * 9/1988 Fang ..... 292/337
4,957,315 * 9/1990 Lin ..... 292/337
5,944,366 * 8/1999 Aramburu ..... 292/1.5
5,957,510 * 9/1999 Kuo ..... 292/1.5

* cited by examiner

*Primary Examiner*—Gary Estremsky
(74) *Attorney, Agent, or Firm*—Jacobson Holman, PLLC

(57) ABSTRACT

A backset adjustment structure for a dead bolt assembly having a dead bolt connected with an operating plate, a support tube connected to support plates, and an operating lever operating the dead bolt, including cover plates enclosing the support plates and each having a hole for receiving the operating lever; a catch plate installed next to the operating plate to be moved along with the cover plates, and having catch grooves in which a given sized catch boss, provided to the operating plate, is fitted; the operating plate having a front end connected with the dead bolt by a pin and able to be turned down, and a space with a slant at its middle; and a button with a protruded slant formed on one of the cover plates, and operating to turn the operating plate down.

4 Claims, 4 Drawing Sheets

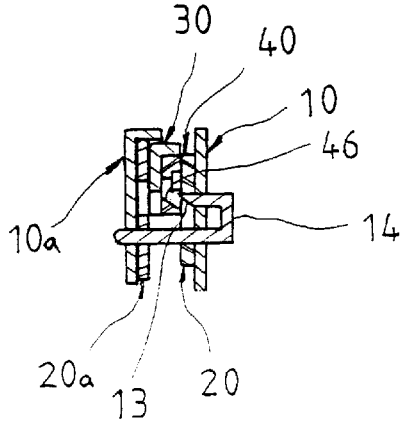
FIG. 4
FIG.5a
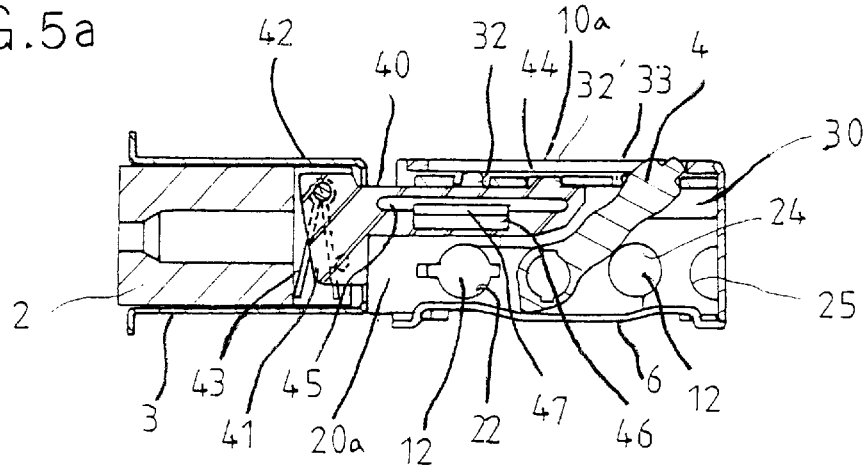
FIG.5b
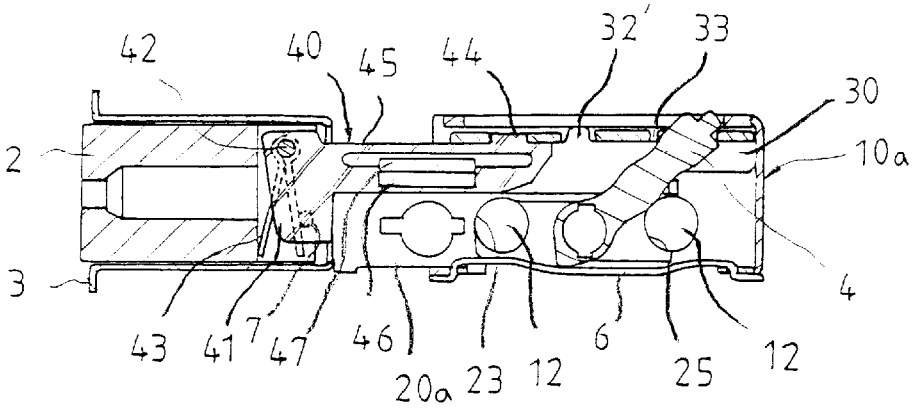

BACKSET ADJUSTMENT STRUCTURE OF DEAD BOLT ASSEMBLY FOR DOOR LOCK

BACKGROUND OF THE INVENTION

1. Field of the Invention

The present invention relates to a backset adjustment structure of a dead bolt assembly provided to a door for locking the door which can adjust a backset distance to 60 mm or 70 mm in a convenient manner.

2. Discussion of Related Art

In order to provide a door lock to a door, an installation hole should be formed on the door, and a distance from the door's end to the installation hole's center is formed to one of two standards: 60 mm or 70 mm. Therefore, the dead bolt assembly has a backset adjustment structure, and according to a conventional structure disclosed in Utility Model Registration No. 83799 and Patent No. 104703 granted to the present applicant, a dead bolt and a bolt head are turned by about 45° and pushed or pulled, and then 45° turned to the original position for the backset adjustment. In another way, the screwy turning has been used for backset adjustment. However, these conventional structures are complicated to cause high production costs, and handling for backset adjustment is not easy and takes time thereby decreasing the yield in mass production. In addition, it is very hard for users to adjust the backset distance, thus requiring the more simple backset adjustment structure.

SUMMARY OF THE INVENTION

An object of the present invention is to provide a backset adjustment structure of a dead bolt assembly for door lock which performs backset adjustment simply by extending or pushing the dead bolt assembly's front and rear portions while pushing a button that was made when manufacturing the dead bolt assembly.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a backset adjustment structure for a dead bolt assembly having a dead bolt connected with an operating plate, a support tube connected to support plates, and an operating lever operating the dead bolt, including cover plates enclosing the support plates and each having a hole for receiving the operating lever; a catch plate installed next to the operating plate to be moved along with the cover plates, and having catch grooves in which a given sized catch boss, provided to the operating plate, is fitted; the operating plate having a front end connected with the dead bolt by a pin and able to be turned down, and a space with a slant at its middle; and a button with a protruded slant formed on one of the cover plates, and operating to turn the operating plate down.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

Figure 1:
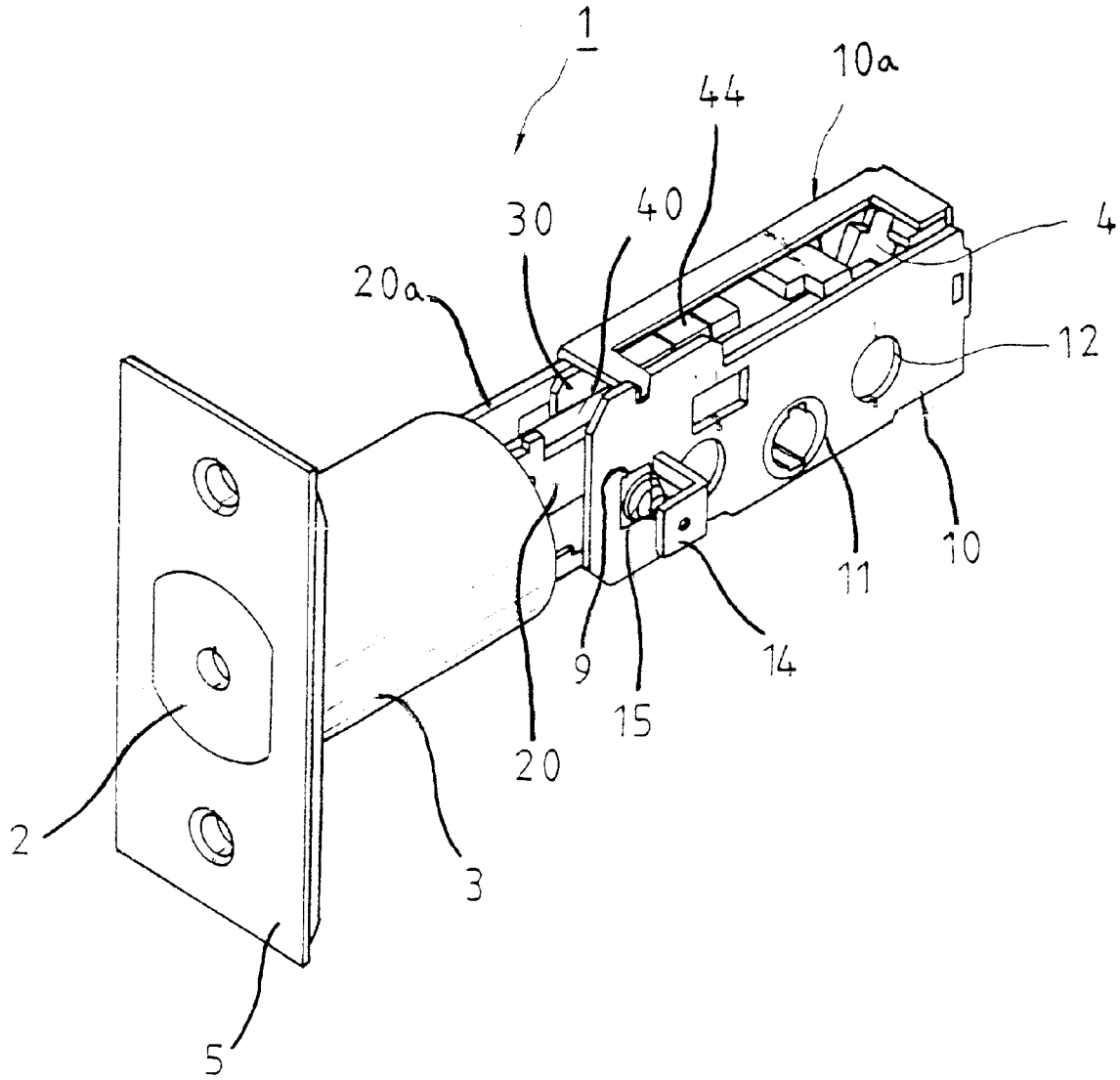
FIG. 1 is a perspective view of a backset adjustment structure of a dead bolt assembly in accordance with the present invention.
Figure 2:
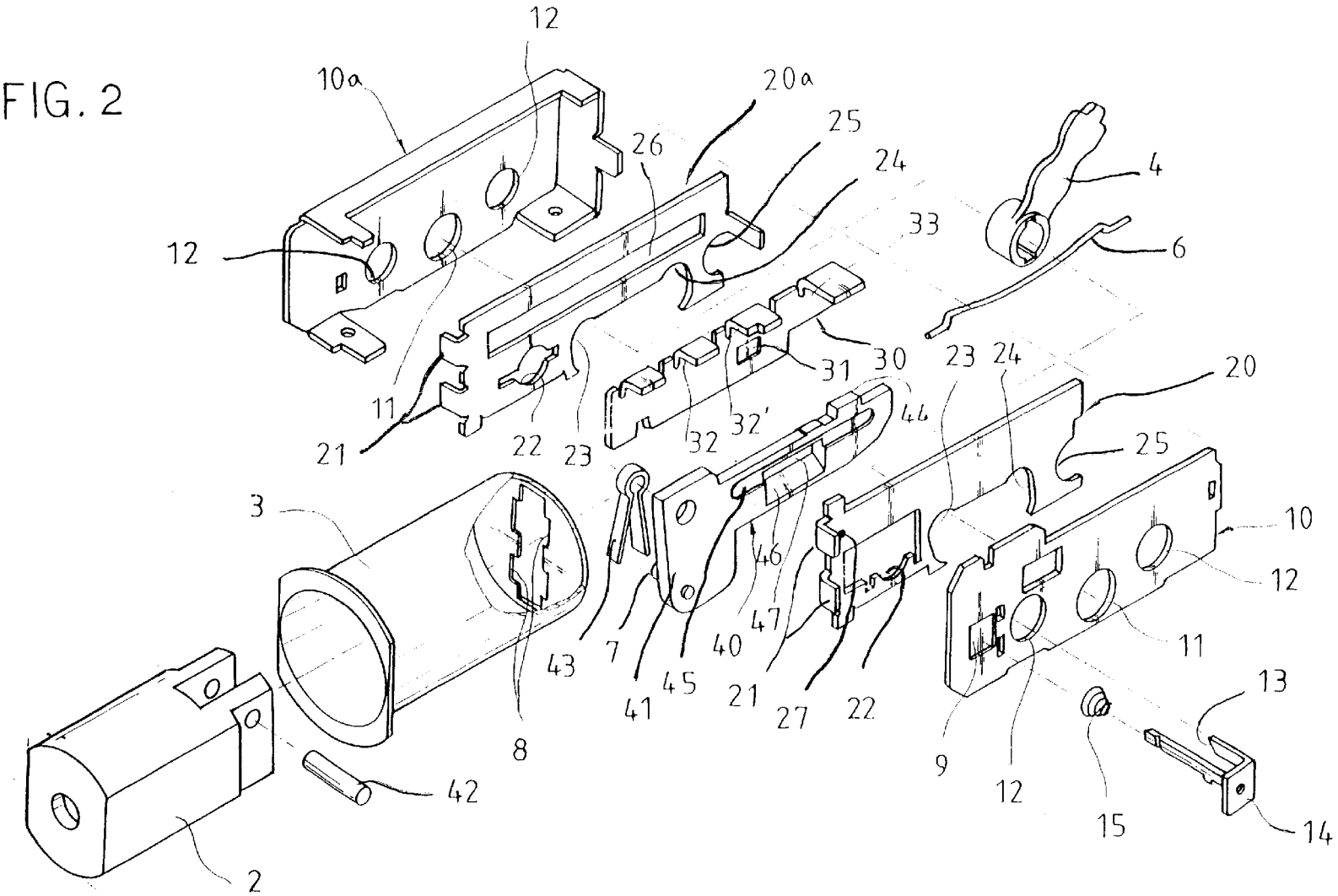
FIG. 2 is an exploded perspective view of the inventive backset adjustment structure.
Figure 3A:
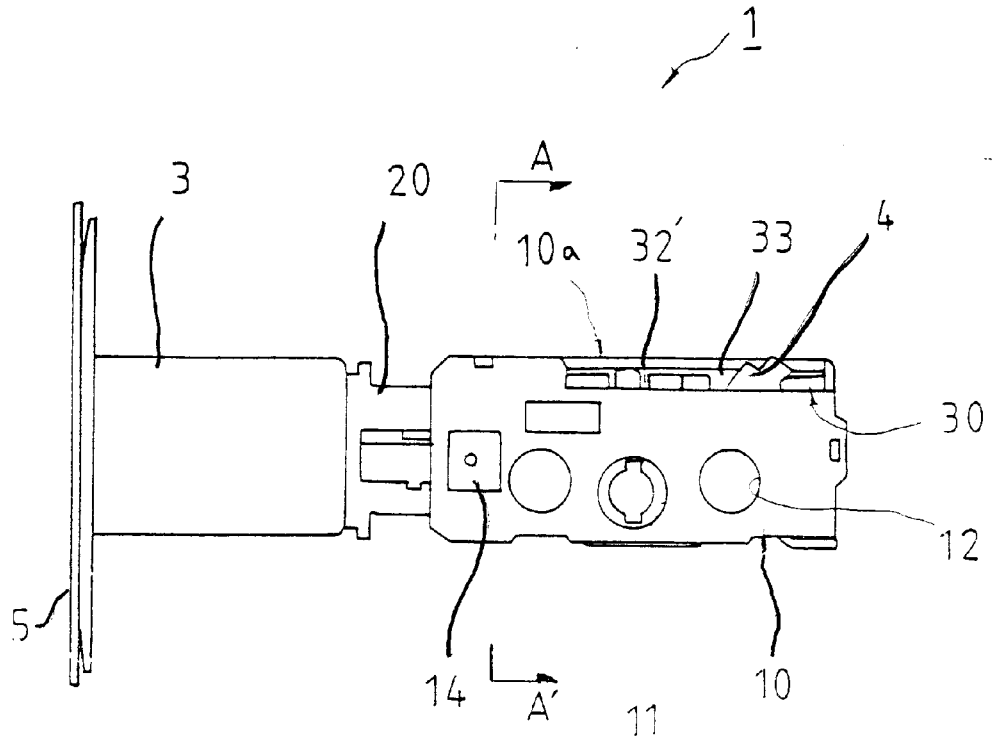
Figure 3B:
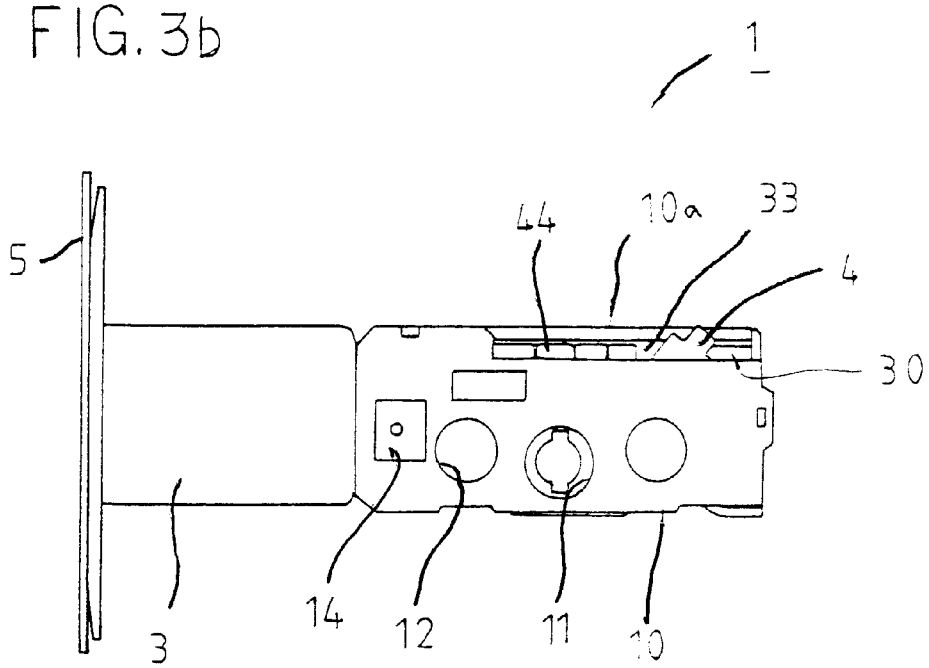

FIGS. 3*a* and 3*b* depict the backset adjustment state in accordance with the present invention, and FIG. 3*a* is a front view with a backset distance of 70 mm while FIG. 3*b* is a front view with a backset distance of 60 mm;

FIG. 4 is an enlarged sectional view as taken along lines A—A' of FIG. 3*a*; and FIGS. 5*a* and 5*b* depict the backset adjustment state in accordance with the present invention, and FIG. 5*a* is a sectional view with a backset distance of 60 mm while FIG. 5*b* is a sectional view with a backset distance of 60 mm.

DETAILED DESCRIPTION OF PREFERRED EMBODIMENT

Reference will now be made in detail to the preferred embodiments of the present invention, examples of which are illustrated in the accompanying drawings.

A dead bolt assembly 1 includes a part of which a dead bolt 2 is inserted into a support tube 3 and is moved forward and backward, and a main body for backset adjustment. More particularly, dead bolt assembly 1 has cover plates 10 and 10*a* at its front and rear parts, two support plates 20 and 20*a* in cover plates 10 and 10*a*, and a catch plate 30 and an operating plate 40 in the middle.

Each of both cover plates 10 and 10*a* has a hole 11 for installation of an operating lever 4 into which a door lock lever's working shaft (not shown) is inserted to move dead bolt 2 forward and backward, and a hole 12 used for coupling the overall door lock to a door.

As both cover plates 10 and 10*a* are joined to each other, the overall dead bolt assembly 1 is completely coupled. Each of support plates 20 and 20*a*, installed in cover plates 10 and 10*a*, has a pair of curved portions 21 on its front end to be coupled to support tube 3, and four concavities 22, 23, 24 and 25 not to shut holes 12 of cover plates 10 and 10*a* even if cover plates 10 and 10*a* are moved forward and backward by 10 mm. Two concavities 23 and 24 formed in the middle are connected to one another to form a space in which operating lever 4 is installed and moved. One support plate 20*a* has a long guide groove 26 while the other plate 20 has a projection 27 at its rear part toward operating plate 40.

Catch plate 30 and operating plate 40 are interposed between two support plates 20 and 20*a*. Catch plate 30 has a guide boss 31 to be moved along guide groove 26, four [-shaped curved portions on its upper section, and catch grooves 32, 32', and an operating groove 33 formed therebetween.

Operating plate 40, moved forward and backward closely contacting catch plate 30, has a coupling portion 41 at its front end to be coupled with dead bolt 2. As dead bolt 2 is coupled to coupling portion 41's upper section via a pin 42, a plate spring 43 is inserted therebetween, and plate 40's front end is slantly designed so that elasticity acts on the overall operating plate 40 to let plate 40 be moved downward. Operating plate 40 has a catch boss 44 at its rear end, and a long space 45 formed in the middle under catch boss 44 to let projection 27 be moved along space 45, and an opening space 47 with a slant 46 formed in the middle of space 47.

A button 14 having a protruded slant 13 is inserted to one cover plate 10, and receives elasticity from a spring 15 supporting button 14. The following reference numerals designate the following parts: 5 an attaching plate; 6 a spring of operating lever 4; 7 a boss mating with plate spring 43; 8 concavities for coupling support plates 20 and 20*a*; and 9 concavity receiving spring 15.

Prior to describing the operation of the inventive structure, in case that the backset distance is 60 mm while operating plate 40's catch boss 44 is being fitted in catch plate 30's rear catch groove 32', cover plates 10 and 10*a*, support plate 20 and 20*a*, and catch plate 30 come to closely contact dead bolt 2, and at this point, the distance from dead bolt 2's front end to the door lock's center, i.e. operating lever 4's center becomes 60 mm. Holes of cover plates 10 and 10*a* correspond to support plates 20 and 20*a*'s concavities 23 and 25.

In this state, if a locking lever (not shown) is turned down by the action of locking the door, operating lever 4 is turned down, and as its front end pushes operating groove 33's opposite end, catch plate 30 is moved toward dead bolt 2, and operating plate 40 caught in catch groove 32' by catch boss 44 comes to move forward so that dead bolt 2 becomes protruded.

If there is a need to adjust the backset distance to 70 mm, as a user moves cover plates 10 and 10*a* backward, holding plates 10 and 10*a* with one hand and pushing button 14 with the other hand, cover plates 10 and 10*a* and catch plate 30 are moved backward to make the backset distance 70 mm. When pushing button 14, since button 14's slant 13 makes friction with operating plate 40's slant 4*b*, operating plate 40 is slightly turned down. At this point, button 14 and operating plate 40 receive the elasticity of plate spring 43 and spring 15, and cath boss 44 of operating plate 40 is separated from catch groove 32' of catch plate 30.

Catch plate 30, coupled to cover plates 10 and 10*a* by operating lever 4, is moved backward by 10 mm if pulling cover plates 10 and 10*a*. After that, as releasing button 14, operating plate 40 and button 14 return to their original states, and catch boss 44 is inserted into another catch groove 32 so that the backset distance is adjusted to 70 mm (FIGS. 3*a* and 5*b*).

Guide boss 31 of catch plate 30 is fitted into guide groove 26 of support plate 20*a* and then guided, and support plate 20's projection 27 is inserted into long space 45 of operating plate 40 and then guided. Even if the backset distance becomes 70 mm by moving cover plates 10 and 10*a* and catch plate 30 backward, concavities 23 and 24 are connected to support plates 20 and 20*a*, and there is no problem with moving operating lever 4. When the backset distance is 70 mm, holes 12 of cover plates 10 and 10*a* correspond to concavities 23 and 25 of support plates 20 and 20*a*.

At this point, dead bolt 2's forward and backward movement is described above, and if changing the backset to 60 mm, cover plates 10 and 10*a* are pushed with pressing button 14 to move catch plate 30. Therefore, catch boss 44 of operating plate 40 is again inserted into catch groove 32', thereby changing the backset distance to 60 mm.

As described above, adjusting the backset distance to 60 mm or 70 mm can be made just by pushing or pulling cover plates 10 and 10*a* with pressing button 14, so it is very convenient to use. Accordingly, efficiency in installation of the dead bolt assembly can be significantly increased, and a consumer can easily handle the backset adjustment.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A deadbolt assembly having a backset adjustment structure, the dead bolt assembly comprising:

a dead bolt connected with an operating plate;

a support tube connected to support plates;

an operating lever operating the dead bolt;

cover plates enclosing the support plates each cover plate having a hole for receiving the operating lever;

a catch plate installed next to the operating plate to be moved along with the cover plates, said catch plate having catch grooves in which a catch boss with a predetermined size formed on the operating plate is fitted;

said operating plate having a front end connected with the dead bolt by a pin and able to be turned down, and a space with a slant at its middle; and a button with a protruded slant inserted into one of the cover plates, and operating to turn the operating plate down.

2. The deadbolt assembly according to claim 1, wherein each of the support plates has concavities that correspond with the holes while the cover plates are moved forward and backward between backset positions a distance of 10 mm while two middle ones of said concavities are connected to each other, and one of the support plates has a guide groove leading the movement of the catch plate while another one of the support plates has a projection.

3. The deadbolt assembly according to claim 1, wherein the catch plate has a pair of catch grooves and an operating groove defined by four bent portions of its upper section, and a guide boss formed on its side surface to be fitted in a guide groove.

4. The deadbolt assembly according to claim 1, wherein the operating plate supports a plate spring with the front end.

* * * * *